US012358695B2

(12) United States Patent
Hu

(10) Patent No.: US 12,358,695 B2
(45) Date of Patent: Jul. 15, 2025

(54) LID STORAGE STRUCTURE OF TRAVEL CUP

(71) Applicant: ZHEJIANG FLY CUP CO.,LTD, Jinhua (CN)

(72) Inventor: Feipeng Hu, Yongkang (CN)

(73) Assignee: ZHEJIANG FLY CUP CO., LTD, Jinhua (CN)

( * ) Notice: Subject to any disclaimer, the term of this patent is extended or adjusted under 35 U.S.C. 154(b) by 0 days.

(21) Appl. No.: 18/760,117

(22) Filed: Jul. 1, 2024

(65) Prior Publication Data

US 2024/0351752 A1 Oct. 24, 2024

(30) Foreign Application Priority Data

Jul. 5, 2023 (CN) ..... 202321751929.9

(51) Int. Cl.
*B65D 43/02* (2006.01)
*B65D 23/10* (2006.01)

(52) U.S. Cl.
CPC ..... *B65D 43/0202* (2013.01); *B65D 23/10* (2013.01); *B65D 2543/00046* (2013.01); *B65D 2543/00842* (2013.01)

(58) Field of Classification Search
CPC ..... B65D 43/0202; B65D 23/10; B65D 2543/00046; B65D 2543/00842
See application file for complete search history.

(56) References Cited

U.S. PATENT DOCUMENTS

| | | | | |
|---|---|---|---|---|
| 8,613,369 | B2 * | 12/2013 | Kitto | B65D 55/16 215/390 |
| 8,905,252 | B2 * | 12/2014 | Latham | B65D 55/16 220/212.5 |
| 10,093,460 | B2 * | 10/2018 | Seiders | B65D 51/242 |
| 10,959,553 | B2 * | 3/2021 | Nichols | B65D 47/122 |
| 2016/0075487 | A1 | 3/2016 | Lin et al. | |
| 2021/0282585 | A1 | 9/2021 | Lee | |
| 2024/0067416 | A1 | 2/2024 | Li | |

* cited by examiner

*Primary Examiner* — James N Smalley
(74) *Attorney, Agent, or Firm* — Hemisphere Law, PLLC; Zhigang Ma

(57) ABSTRACT

The present disclosure belongs to the technical field of cups, and in particular, to a lid storage structure of a travel cup, including a cup body and a lid, wherein a drinking opening is formed in the lid; the drinking opening is provided with a drinking opening cover; a metal member is arranged on the drinking opening cover; a magnetic suction portion is arranged on the lid; a handle is further arranged on the lid; the handle is located on one side of the magnetic suction portion and forms a space with the magnetic suction portion; and when the drinking opening cover is sucked to the magnetic suction portion, one side of the drinking opening cover resists against the handle.

4 Claims, 6 Drawing Sheets

LID STORAGE STRUCTURE OF TRAVEL CUP

TECHNICAL FIELD

The present disclosure belongs to the technical field of cups, and in particular, to a lid storage structure of a travel cup.

BACKGROUND

Scientific research has found that drinking water can promote the metabolism of a human body. A person needs to drink 1.5 liters to 2 liters of water a day to ensure the normal metabolism. A lid is configured for dust prevention and thermal insulation of a cup. As a tool configured to accommodate liquid in daily life, the cup has been widely used. A travel cup has the advantages of small size, convenience of carrying, and convenience of use, and it is convenient for a user to carry and use the travel cup when going out. People like to take this travel cup for daily travel, tourism, and outdoor sports. However, at present, as for a travel cup on the market, a user has to find a place to place a lid when drinking water. In a vehicle or in the open air, there is no place to place a lid or it is inconvenient to place a lid because there is no clean place. Placing a lid at will may contaminate the lid. If the contaminated lid is covered back to the cup, a cup rim may be contaminated too. Furthermore, a lid typically has a small volume. If it is placed at will, the lid is easy to lose or easily rolls away.

SUMMARY

The present disclosure aims to provide a lid storage structure of a travel cup, which has a simple structure, and a lid is hard to lose and is cleaner.

The objective of the present disclosure is achieved below:

A lid storage structure of a travel cup includes a cup body and a lid, wherein a drinking opening is formed in the lid; the drinking opening is provided with a drinking opening cover; a metal member is arranged on the drinking opening cover; a magnetic suction portion is arranged on the lid; a handle is further arranged on the lid; the handle is located on one side of the magnetic suction portion and forms a space with the magnetic suction portion; and when the drinking opening cover is sucked to the magnetic suction portion, one side of the drinking opening cover rests against the handle.

Further, a mounting portion is arranged at a circumferential edge of the lid; the mounting portion is beveled; and the magnetic suction portion is arranged on the mounting portion.

Further, the drinking opening cover is detachably provided on the drinking opening; and the drinking opening is higher than an upper surface of the lid.

Further, the handle is U-shaped and is fixedly connected to the lid.

Further, an internal thread is provided on the lid; an external thread is arranged on the cup body; and the lid is in threaded connection to the cup body.

Compared with the prior art, the present disclosure has outstanding and beneficial technical effects:

The lid storage structure of the travel cup has a simple structure, and a lid is hard to lose and cleaner. The lid storage structure of the travel cup includes a cup body and a lid, wherein a drinking opening is formed in the lid; the drinking opening is provided with a drinking opening cover; a metal member is arranged on the drinking opening cover; a magnetic suction portion is arranged on the lid; a handle is further arranged on the lid; the handle is located on one side of the magnetic suction portion and forms a space with the magnetic suction portion; and when the drinking opening cover is sucked to the magnetic suction portion, one side of the drinking opening cover rests against the handle. To drink water, the drinking opening cover is opened and placed on the magnetic suction portion, so that the drinking opening cover is hard to lose and cleaner; the drinking opening cover does not need to be placed at will or held in a hand, so that contamination of the lid caused by random placement is prevented; and the lid storage structure of the travel cup is more suitable for outdoor sports and tourism.

MEANINGS OF REFERENCE NUMERALS IN THE DRAWINGS

Figure 1:
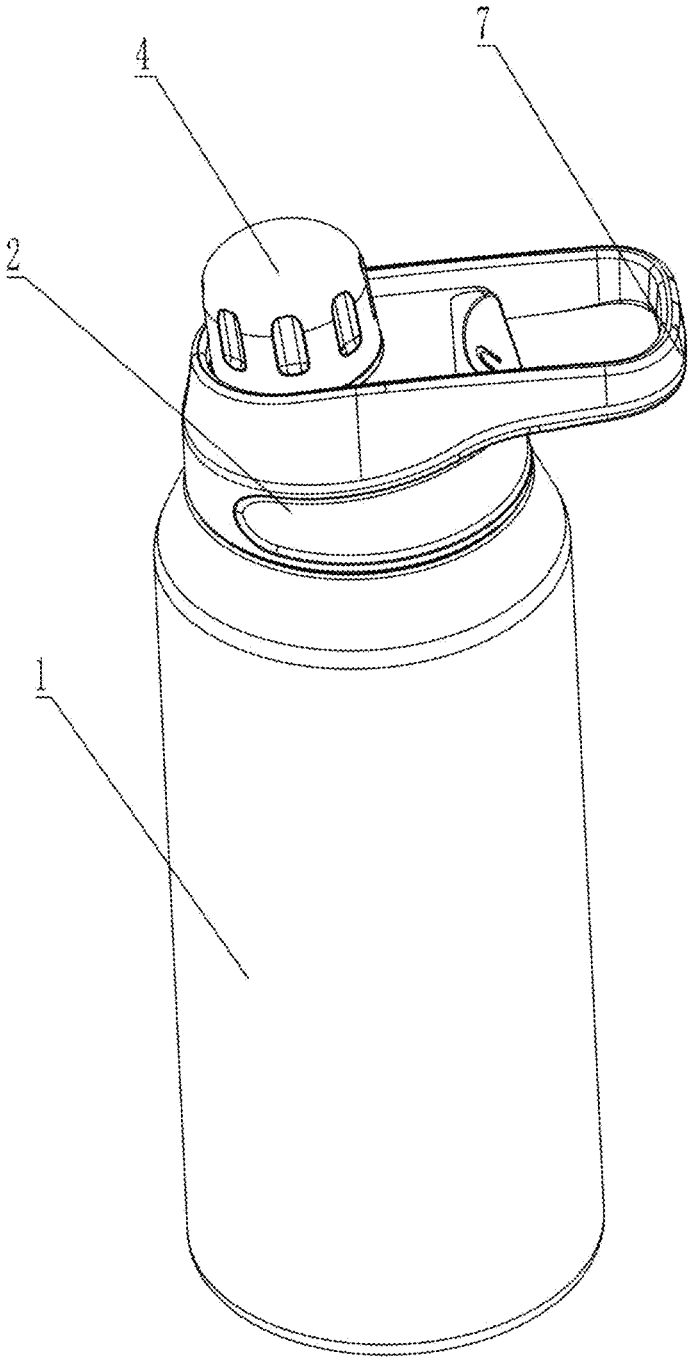
FIG. 1 is a three-dimensional diagram of the present disclosure.
Figure 2:
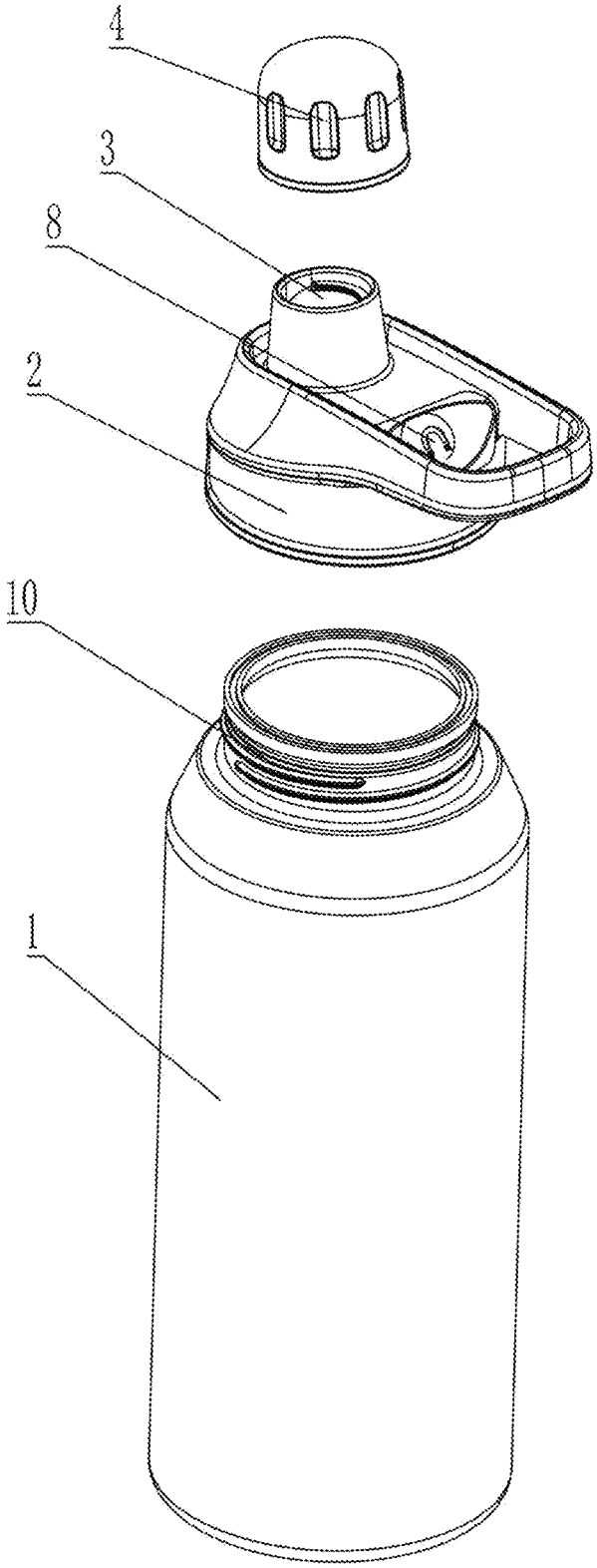
FIG. 2 is an exploded view of the present disclosure.
Figure 3:
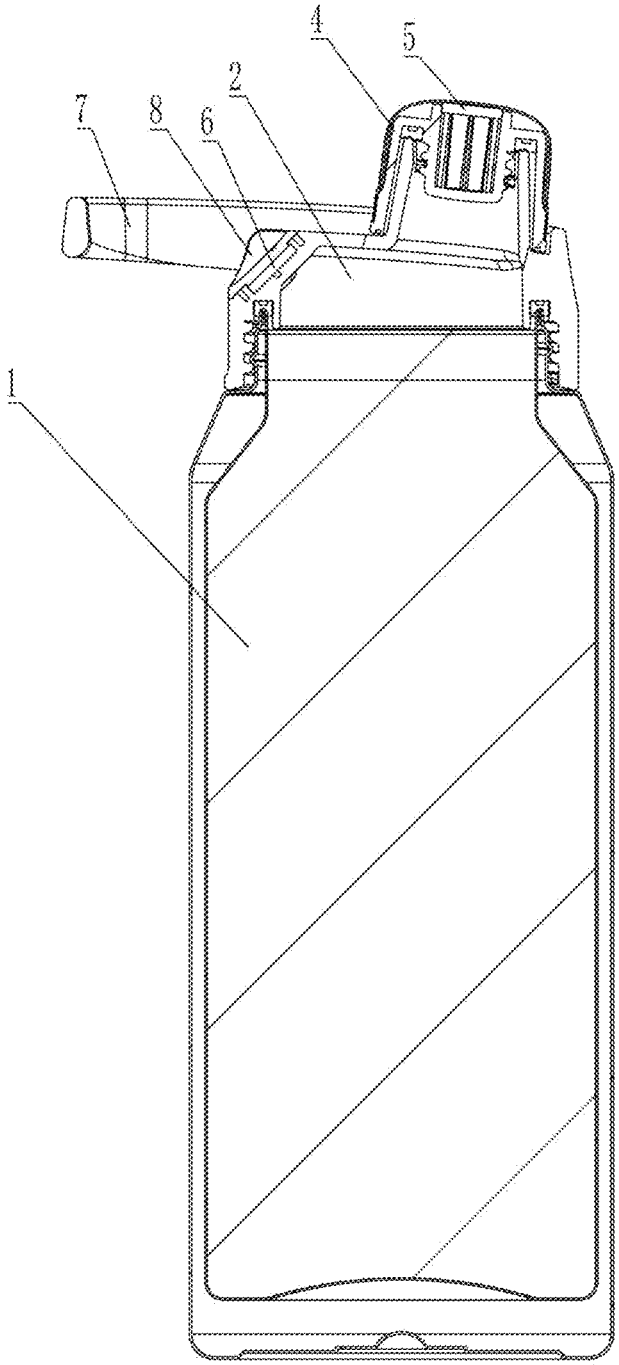
FIG. 3 is cross-sectional view of the present disclosure.
Figure 4:
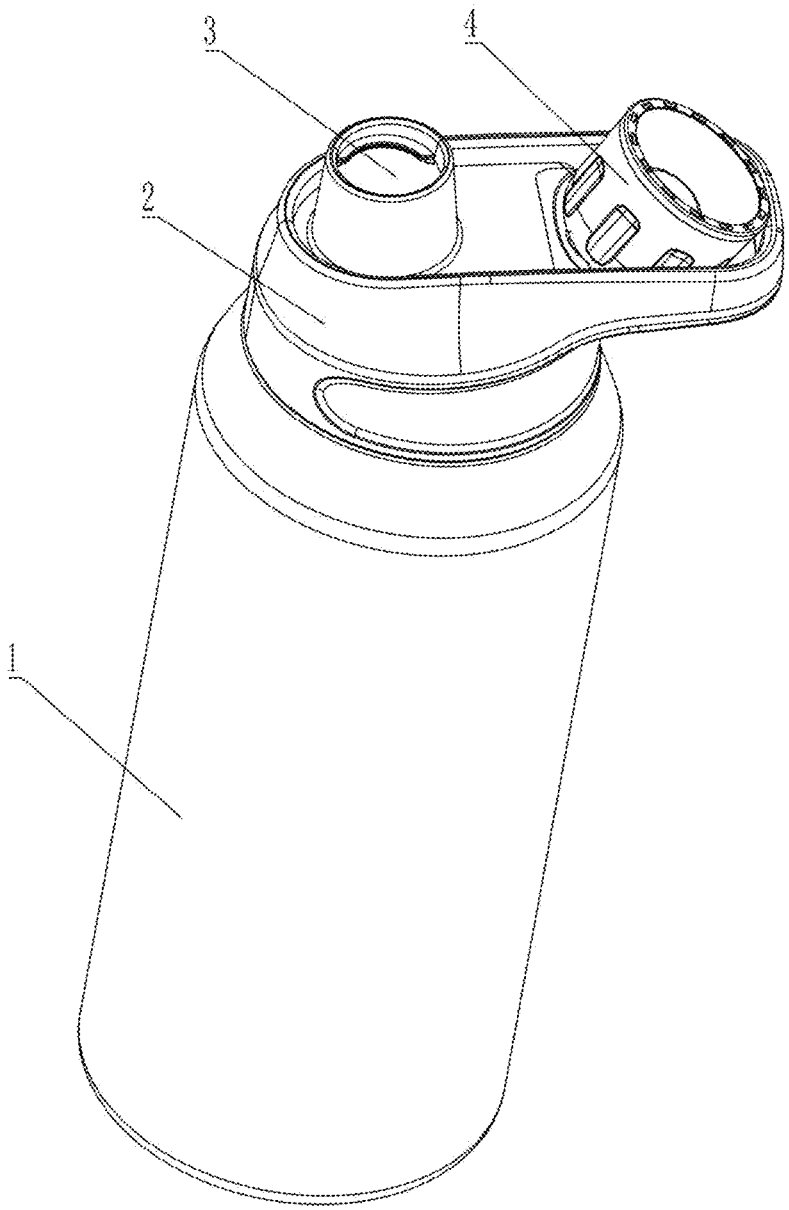
FIG. 4 is a reference diagram of a use state of the present disclosure.
Figure 5:
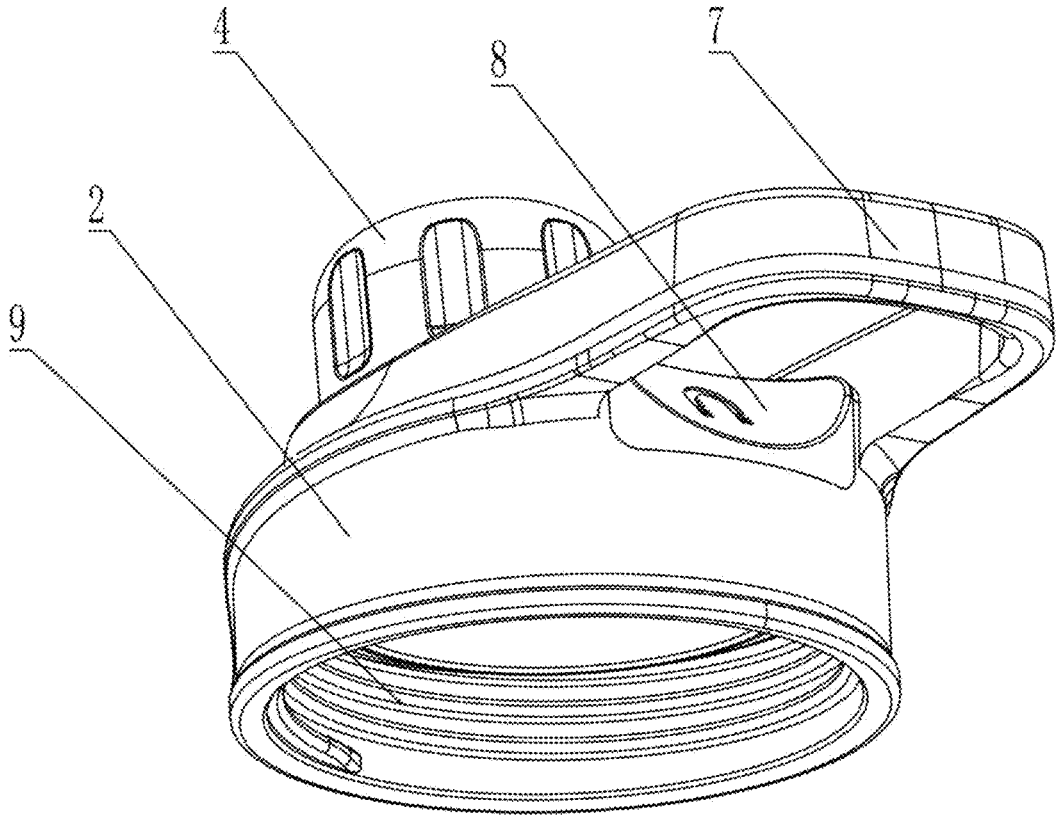
FIG. 5 is a schematic structural diagram of a lid of the present disclosure.
Figure 6:
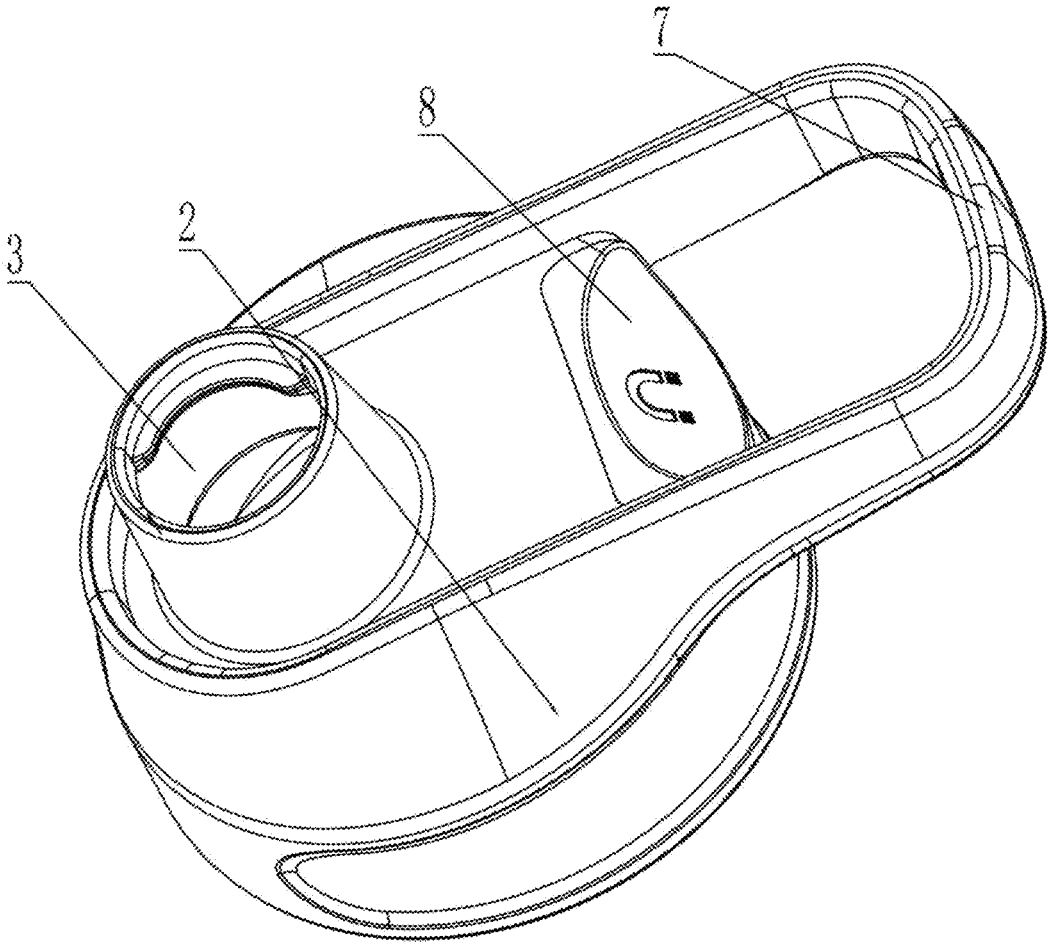
FIG. 6 is a schematic structural diagram of removing a drinking opening cover from a lid according to the present disclosure.

1: cup body; 2: lid; 3: drinking opening; 4: drinking opening cover; 5: metal member; 6: magnetic suction portion; 7: handle; 8: mounting portion; 9: internal thread; and 10: external thread.

DETAILED DESCRIPTION OF THE EMBODIMENTS

The present disclosure will be further described below in conjunction with specific embodiments.

A lid storage structure of a travel cup includes a cup body 1 and a lid 2, wherein a drinking opening 3 is formed in the lid 2; the drinking opening 3 is provided with a drinking opening cover 4; a metal member 5 is arranged on the drinking opening cover 4; a magnetic suction portion 6 is arranged on the lid 2; a handle 7 is further arranged on the lid 2; the handle 7 is located on one side of the magnetic suction portion 6 and forms a space with the magnetic suction portion 6; and when the drinking opening cover 4 is sucked to the magnetic suction portion 6, one side of the drinking opening cover rests against the handle 7.

The lid storage structure of the travel cup has a simple structure, and a lid is hard to lose and cleaner. The lid storage structure of the travel cup includes a cup body 1 and a lid 2, wherein a drinking opening 3 is formed in the lid 2; the drinking opening 3 is provided with a drinking opening cover 4; a metal member 5 is arranged on the drinking opening cover 4; a magnetic suction portion 6 is arranged on the lid 2; a handle 7 is further arranged on the lid 2; the handle 7 is located on one side of the magnetic suction portion 6 and forms a space with the magnetic suction portion 6; and when the drinking opening cover 4 is sucked to the magnetic suction portion 6, one side of the drinking opening cover rests against the handle 7. To drink water, the drinking opening cover 4 is opened and placed on the magnetic suction portion 6, so that the drinking opening cover is hard to lose and cleaner; the drinking opening cover does not need to be placed at will or held in a hand, so that contamination of the lid 2 caused by random placement is prevented; and the lid storage structure of the travel cup is more suitable for outdoor sports and tourism.

Preferably, a mounting portion 8 is arranged at a circumferential edge of the lid 2; the mounting portion 8 is beveled; and the magnetic suction portion 6 is arranged on the mounting portion 8, which is convenient for storing the drinking opening cover 4.

Preferably, the drinking opening cover 4 is detachably provided on the drinking opening 3; and the drinking opening 3 is higher than an upper surface of the lid 2. This is convenient for drinking. Furthermore, when the drinking opening cover 4 is closed, the drinking opening 3 can be completely closed, so as to avoid contamination with dirt when this product is not used.

Preferably, the handle 7 is U-shaped and is fixedly connected to the lid 2. It is convenient for carrying when this product is not used.

Preferably, an internal thread 9 is provided on the lid 2; an external thread 10 is arranged on the cup body 1; and the lid 2 is in threaded connection to the cup body 1. Due to the threaded connection, the structure is simple.

The above embodiments are only preferred embodiments of the present disclosure, and do not limit the protection scope of the present disclosure. Therefore, any equivalent changes made on the basis of the structure, shape, and principle of the present disclosure shall all fall within the protection scope of the present disclosure.

What is claimed is:

1. A lid storage structure of a travel cup, comprising a cup body (1) and a lid (2), wherein a drinking opening (3) is formed in the lid (2); the drinking opening (3) is provided with a drinking opening cover (4); a metal member (5) is arranged on the drinking opening cover (4), and the drinking opening cover (4) is detachably provided on the drinking opening (3); a magnetic suction portion (6) is arranged on the lid (2); a handle (7) is further arranged on the lid (2); the handle (7) is located on one side of the magnetic suction portion (6) and forms a space with the magnetic suction portion (6); and when the drinking opening cover (4) is sucked to the magnetic suction portion (6), one side of the drinking opening cover rests against the handle (7); wherein a mounting portion (8) is arranged at a circumferential edge of the lid (2); the mounting portion (8) is beveled; and the magnetic suction portion (6) is arranged on the mounting portion (8).

2. The lid storage structure of the travel cup according to claim 1, wherein the drinking opening (3) is higher than an upper surface of the lid (2).

3. The lid storage structure of the travel cup according to claim 2, wherein the handle (7) is U-shaped and is fixedly connected to the lid (2).

4. The lid storage structure of the travel cup according to claim 1, wherein an internal thread (9) is provided on the lid (2); an external thread (10) is arranged on the cup body (1); and the lid (2) is in threaded connection to the cup body (1).

* * * * *